US012196494B2

(12) United States Patent
Zhang et al.

(10) Patent No.: US 12,196,494 B2
(45) Date of Patent: Jan. 14, 2025

(54) GAS FURNACE WITH HEAT EXCHANGER

(71) Applicant: Goodman Manufacturing Company, L.P., Waller, TX (US)

(72) Inventors: Jianmin Zhang, Katy, TX (US); Brian Russell, Katy, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 0 days.

(21) Appl. No.: 18/058,354

(22) Filed: Nov. 23, 2022

(65) Prior Publication Data

US 2023/0204295 A1 Jun. 29, 2023

Related U.S. Application Data

(60) Provisional application No. 63/266,124, filed on Dec. 29, 2021.

(51) Int. Cl.
*F28D 1/047* (2006.01)
*F24H 3/08* (2022.01)
(Continued)

(52) U.S. Cl.
CPC ..... *F28D 1/0477* (2013.01); *F24H 3/08* (2013.01); *F24H 3/087* (2013.01); *F28D 21/00* (2013.01);
(Continued)

(58) Field of Classification Search
CPC . F24H 3/08; F24H 3/087; F24H 3/105; F28D 1/0477; F28D 21/00; F28D 2021/0056; F28F 1/006; F28F 13/08
See application file for complete search history.

(56) References Cited

U.S. PATENT DOCUMENTS 4,515,145 A 5/1985 Tallman et al.
4,974,579 A * 12/1990 Shellenberger ..... F24H 3/087 126/110 R
(Continued)

FOREIGN PATENT DOCUMENTS

KR 20170135123 A 12/2017

OTHER PUBLICATIONS

International Search Report and Written Opinion dated Apr. 4, 2023 for corresponding PCT Patent Application No. PCT/US2022/080380 filed on Nov. 23, 2022.

*Primary Examiner* — Eric S Ruppert
*Assistant Examiner* — Hans R Weiland
(74) *Attorney, Agent, or Firm* — K&L Gates LLP

(57) ABSTRACT

A furnace assembly for use with a gas fuel that includes a cabinet and a burner located in the cabinet that is operable to ignite the gas fuel. The furnace also includes a heat exchanger assembly in communication with the burner and open to receiving the ignited gas fuel, the heat exchanger assembly including tubes. Each tube includes a first section with an inlet, a horizontal section having a first internal diameter, and a vertical section. Each tube also includes a second section extending from the first section and having a second internal diameter less than the first internal dimeter. The second section also includes a serpentine flow path up and down in the vertical direction and an outlet. The gas fuel entering a tube stays in the tube until flowing out of the tube. The furnace also includes a blower operable to move air through the cabinet and over the heat exchanger assembly.

16 Claims, 3 Drawing Sheets

(51) Int. Cl.
*F28D 21/00* (2006.01)
*F28F 1/00* (2006.01)
*F28F 13/08* (2006.01)

(52) U.S. Cl.
CPC ..... *F28F 1/006* (2013.01); *F28F 13/08* (2013.01); *F28D 2021/0056* (2013.01)

(56) References Cited

U.S. PATENT DOCUMENTS

| | | | | | |
|---|---|---|---|---|---|
| 5,042,453 | A | | 8/1991 | Shellenberger | |
| 5,060,722 | A | * | 10/1991 | Zdenek | F28F 13/08 165/170 |
| 5,222,552 | A | | 6/1993 | Schuchert | |
| 5,301,654 | A | | 4/1994 | Weber, III et al. | |
| 5,664,555 | A | * | 9/1997 | Maschhoff | F24H 3/087 126/91 A |
| 2010/0078007 | A1 | * | 4/2010 | Post | F04D 29/422 126/112 |
| 2010/0122806 | A1 | * | 5/2010 | Halgash | F24H 3/087 165/172 |
| 2011/0100349 | A1 | * | 5/2011 | Hugghins | F24H 9/2085 126/116 A |
| 2016/0003559 | A1 | * | 1/2016 | Bradbury | F16L 41/082 165/76 |

* cited by examiner

GAS FURNACE WITH HEAT EXCHANGER

BACKGROUND

This section is intended to introduce the reader to various aspects of the art that may be related to various aspects of the presently described embodiments—to help facilitate a better understanding of various aspects of the present embodiments. Accordingly, it should be understood that these statements are to be read in this light, and not as admissions of prior art.

A residential furnace includes a heat exchanger (HX) that has a bank of stainless steel or aluminum heat exchange tubes arranged such that air circulated by a blower passes between the tubes to be heated before the heated air passes to a distribution duct. Each of the tubes has an inlet end into which the flame of a burner extends to heat and combust a fuel such as gas, an outlet end which is fluidly connected to an inducer for drawing the heated gas therethrough, and a plurality of passes through which the heated flue gas passes. The fuel, for example, natural gas, is combusted in the burner. The combustion gas, flue gas, is routed through the HX, which extracts the heat therefrom. The flue gas heats the surface of the HX and air is blown across the exterior of the HX thus removing heat from the HX by convection. Efficiency is measured by the amount of heat energy that is transferred out of the flue gas compared to the amount of heat energy that is available by the flue gas. It can be determined roughly by knowing how much air and gas enters and is burned in the HX, and the temperature of the gas leaving the HX.

In order to obtain the desired high efficiencies of operation, it is necessary to maximize the heat transfer that occurs between the heated gas within the heat exchanger passes and the circulating air passing over the outer sides of the heat exchanger tubes. Efficiency of the furnace is typically increased by increasing the size, or height, of the heat exchanger. However, design considerations require reducing the height of the heat exchanger. This is important for a number of reasons. First, it allows the overall height of the furnace to be reduced such that it can be placed in smaller spaces, such as in attics, crawl spaces, closets and the like. Secondly, it allows for a reduction in costs, both in the costs of the heat exchanger panels themselves and in the cost of the furnace cabinet. But this reduction in height must be done without sacrificing performance. That is, a simple reduction in height, with a proportionate reduction in performance, would not be acceptable. It is therefore necessary to obtain increased performance for a given length or height of the heat exchanger panels.

Durability of the heat exchanger panels is also an important requirement. In order to obtain long life, the heat exchanger panels must be free of excessive surface temperatures, or hotspots, and the thermal stresses must be minimized. Further, the need for expensive high temperature materials is preferably avoided. It is desirable to maximize the heat exchange surface area within the confined or restricted volume inside the furnace. Accordingly, each tube is bent into a serpentine configuration so as to increase the length of each tube that will fit into the furnace.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a gas furnace for use with a gas fuel that includes a cabinet and a burner located in the cabinet that is operable to ignite the gas fuel. The furnace also includes a heat exchanger assembly in communication with the burner and open to receiving the ignited gas fuel, the heat exchanger assembly including tubes. Each tube includes a first section with an inlet, a horizontal section having a first internal diameter, and a vertical section. Each tube also includes a second section extending from the first section and having a second internal diameter less than the first internal dimeter. The second section also includes a serpentine flow path up and down in the vertical direction and an outlet. The gas fuel entering a tube stays in the tube until flowing out of the tube. The furnace also includes a blower operable to move air through the cabinet and over the heat exchanger assembly. In at least one embodiment, the serpentine flow path of the second section also comprises a wave or zig-zag pattern back and forth in the horizontal direction.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
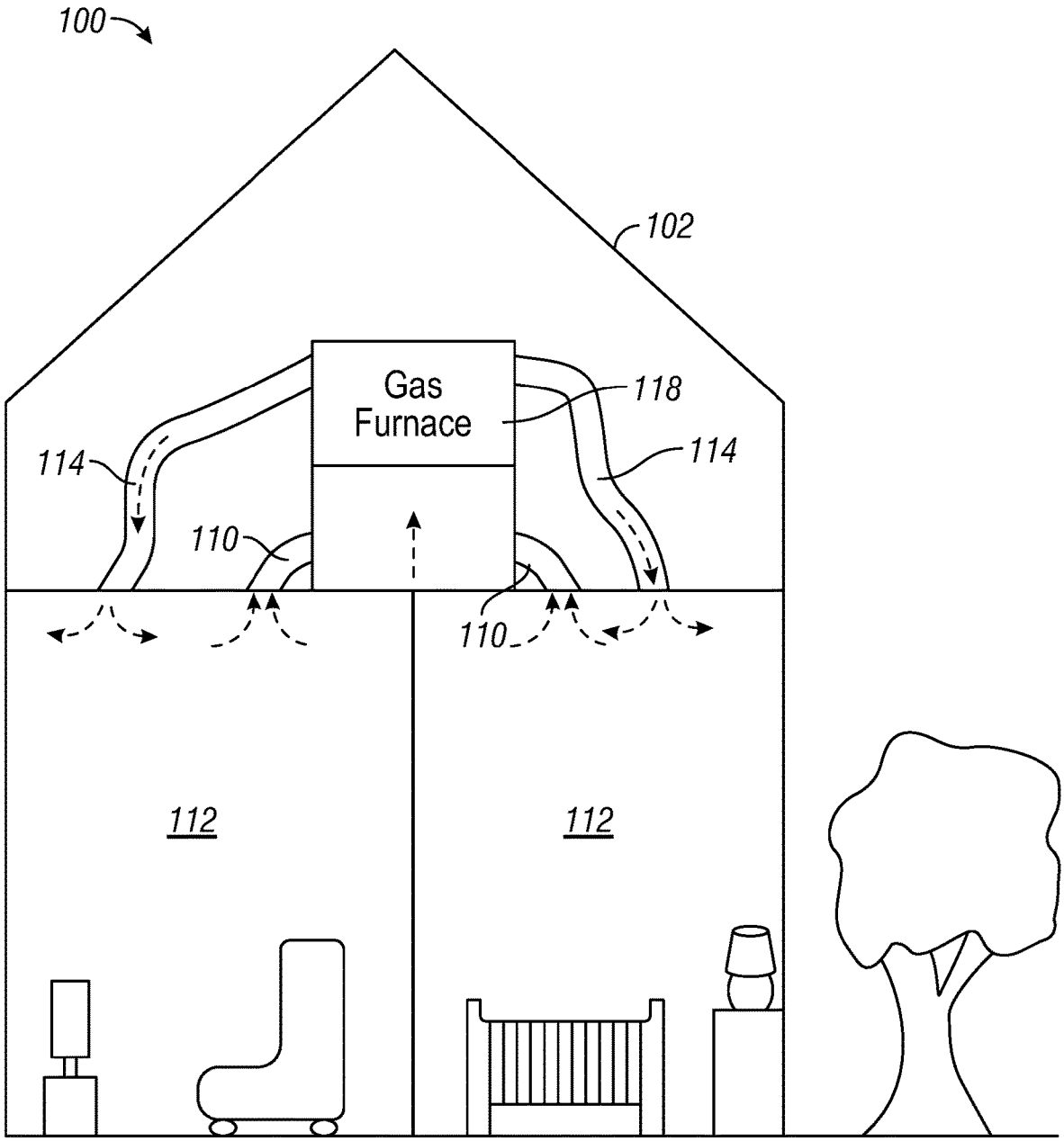
FIG. 1 is a schematic view a structure with a furnace, in accordance with one or more embodiments.

Turning to the figures, FIG. 1 illustrates a schematic of a heating system 100 in accordance with one or more embodiments. As depicted, the heating system 100 heats a residential structure 102. However, the concepts disclosed herein are applicable to numerous of heating situations, which include industrial and commercial settings.

To heat the structure 102, the heating system 100 draws ambient indoor air via returns 110, passes that air over a source of heating, and then routes the heated air back to the various climate-controlled spaces 112 through ducts or ductworks 114—which are relatively large pipes that may be rigid or flexible.

As shown, the heating system 100 includes a gas furnace 118. The gas furnace 118 combusts fuel, such as natural gas, to produce heat in furnace tubes (shown in detail below) that serpentine through the gas furnace 118. These furnace tubes act as a heating element for the ambient indoor air being pushed over the furnace tubes and into the ducts 114.

Figure 2A:
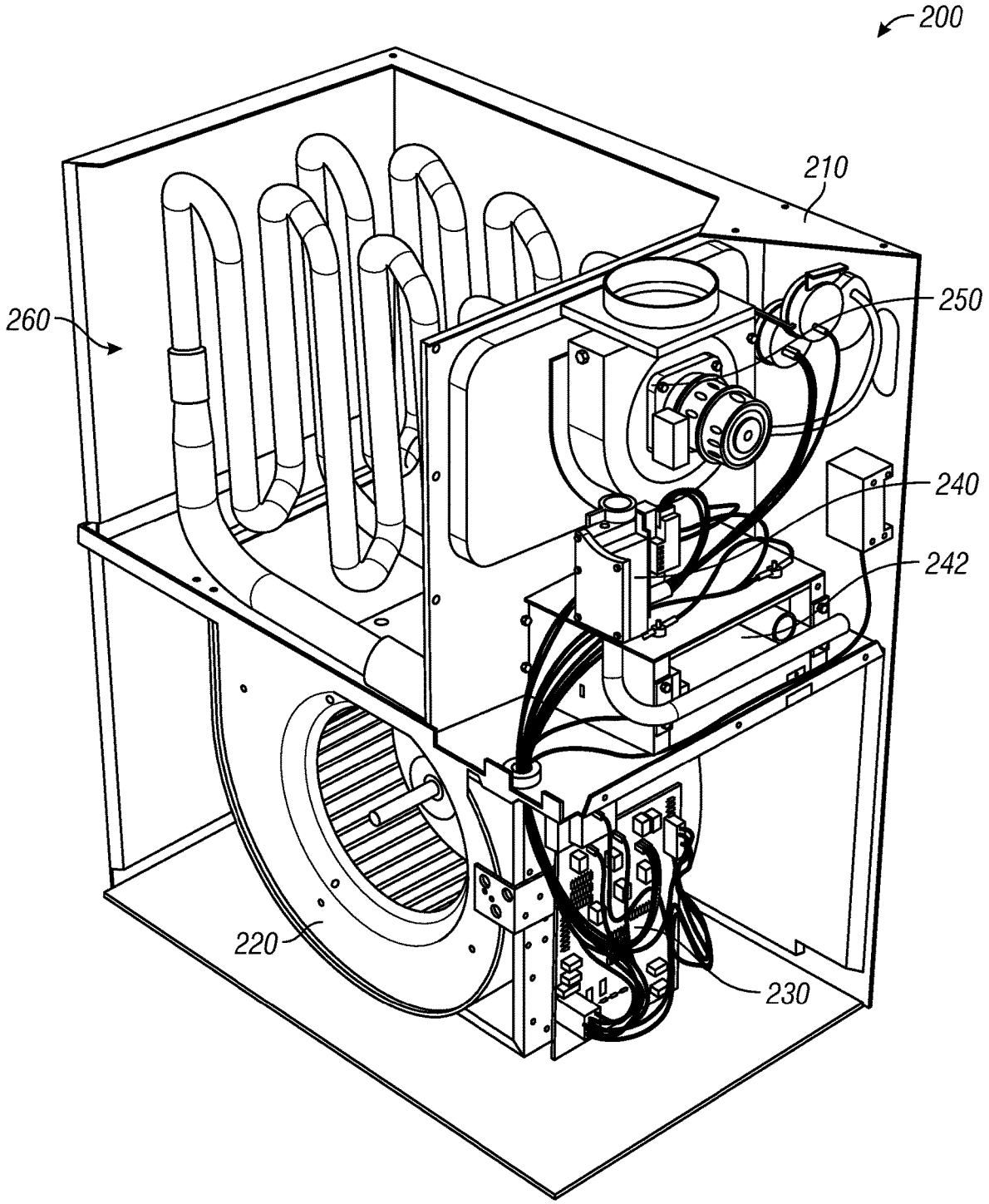
FIG. 2A is a perspective view of a furnace assembly, in accordance with one or more embodiments.

FIG. 2A illustrates a perspective view of a furnace assembly 200 that may be used as the furnace 118 shown in FIG. 1. The furnace assembly 200 is described without limitation in terms of a gas-fired system. Those skilled in the pertinent art will appreciate that the principles disclosed herein may be extended to furnace systems using other fuel types. The furnace assembly 200 includes a cabinet 210 that may be made of, for example, heavy-gauge steel with a durable baked-enamel finish to resist corrosion and protect components inside the cabinet 210. In some locations, the cabinet may also be thermally insulated to reduce heat loss and maximize heat transfer efficiency as well as lower operation noise. The cabinet 210 encloses a blower 220, which may be a variable-speed blower 220 for ramping up and down airflow according to the furnace performance demand. The cabinet 210 also encloses a controller 230 that may include self-diagnostic capabilities and may also continuously monitor and control the operation of the furnace assembly 200. To ignite and combust the gas fuel, the cabinet 210 also encloses a gas valve 240, which may be a two-stage valve, and a burner assembly 242, which includes an igniter such as a silicon nitride igniter that does not need a pilot light. The burner assembly 242 may optionally be enclosed in a burner box as illustrated. The cabinet 210 also encloses a heat exchanger (HX) assembly 260 (discussed in more detail below) and an induced draft blower 250, which may be, for example, a variable-speed blower. The HX assembly 260 includes multiple tubes 262 that may be made of, for example, stainless steel. The HX assembly 260 works with the burner assembly 242 and the induced draft blower 250 to burn a heating gas fuel, e.g. natural gas, and move exhaust gases through the HX assembly 260 and out of the furnace 200. The controller 230 further controls the blower 220 to move air over the HX assembly 260, thereby transferring heat from the exhaust gases to an airstream 290 (shown in FIG. 2B) forced over the HX assembly 260 by the blower 120 of FIG. 1.

In some situations, the vertical dimensions (height) of the furnace 200 is constrained to provide space for other components in a limited space, such as a furnace closet. Such other components may include, e.g., an air filter, a sterilizer, or an air conditioning coil. To accommodate such installation options, the height of the HX assembly 260 may be constrained. For example, the height of the entire furnace cabinet may be limited to 30 inches. Such a constraint limits the space available to recover heat from the tubes 262. Various embodiments described herein make possible the recovery of heat that might otherwise be lost due to such size constraints while maintaining a desired efficiency level for the HX assembly 260. For example, one efficiency level metric is an annual fuel efficiency rating (AFUE). AFUE measures a gas furnace's efficiency in converting fuel to energy. A furnace that has at least an 80% AFUE rating can turn at least 80% of the energy it consumes into heat. The other 20% is used during the heating process. The furnace 200 may, for example, be required to maintain a AFUE of at least 80% while at the same time not being taller than 30 inches.

Figure 2B:
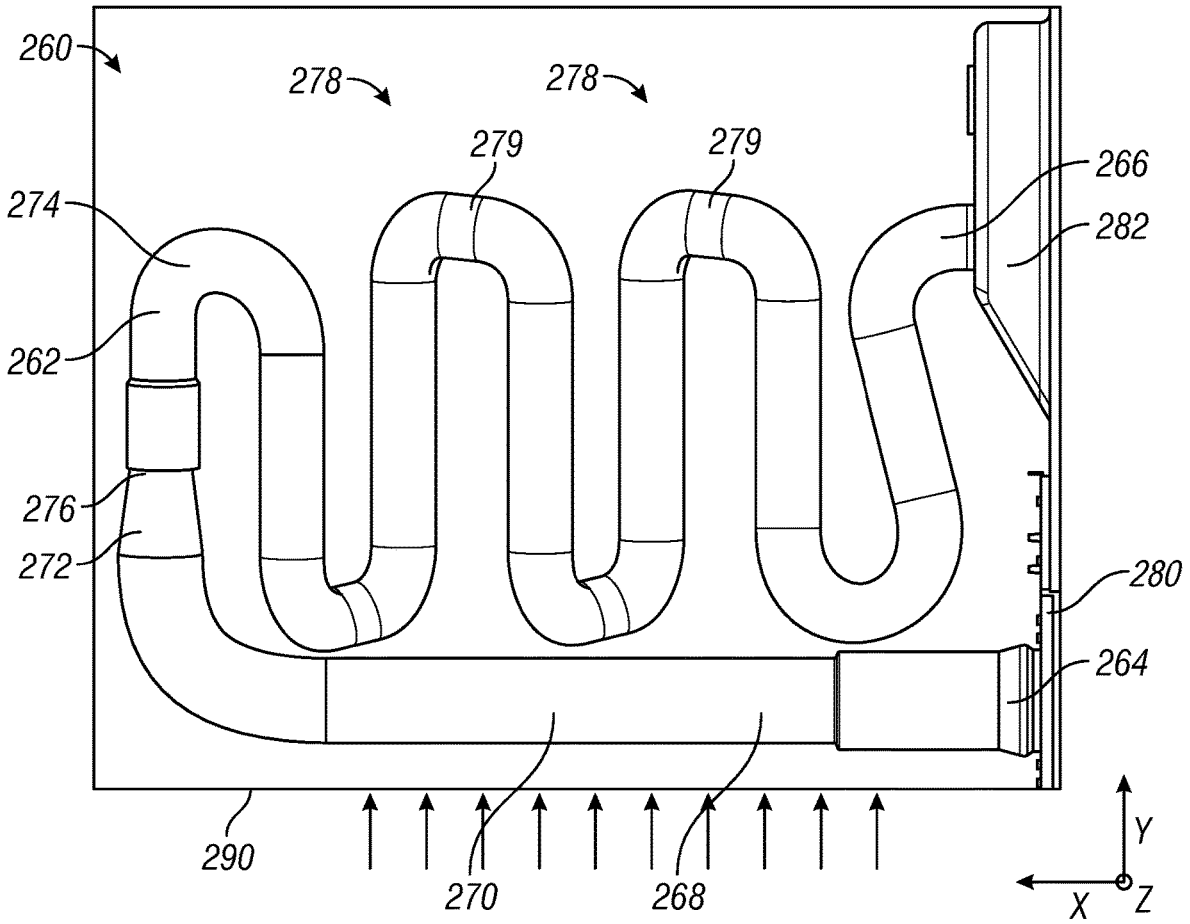
FIG. 2B is a top view a heat exchanger assembly of the furnace assembly of FIG. 2A, in accordance with one or more embodiments.
Figure 2C:
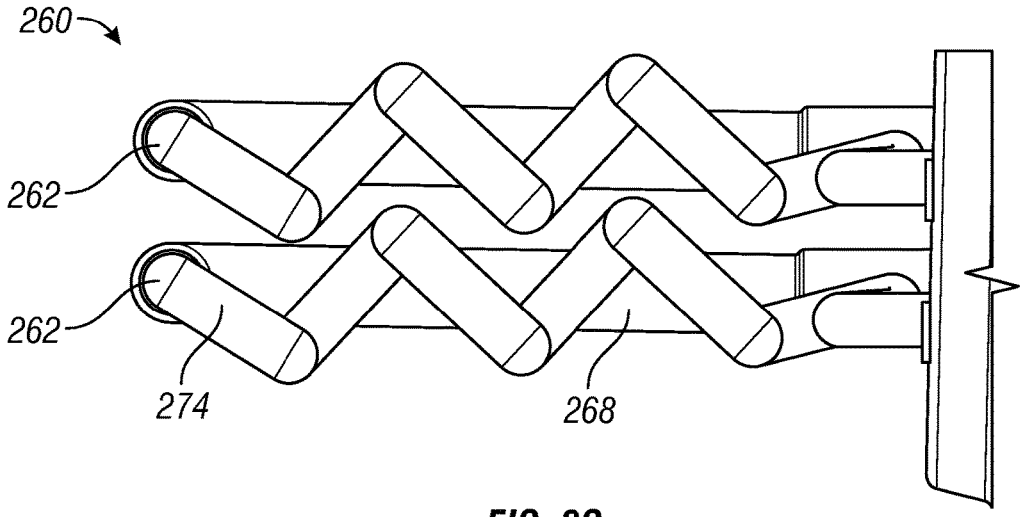
FIG. 2C is a side view of the heat exchanger assembly of FIG. 2B, in accordance with one or more embodiments.

FIG. 2B illustrates a side view of a single tube 262 of and FIG. 2C illustrates a top view of the HX assembly 260. As seen in FIGS. 2B and 2C, coordinate xyz axes are illustrated for reference. The x-axis represents a horizontal direction, the y-axes represents a vertical direction, and the z-axis represents a sideways direction. The HX assembly 260 is illustrated by way of example without limitation to a particular configuration of a plurality of tubes 262 and associated components. The tube 262 in FIG. 2B is representative of each tube 262 of the plurality of tubes 262. The tubes 262 are joined at an inlet 264 to a panel 280 and at an outlet 266 to a collector box manifold 282 on the same side of the HX assembly 260 as the panel 280. The burning fuel stream enters the tube(s) 262 at the inlet 264. The exhaust from the combusted fuel stream leaves the HX assembly 260 at the outlet 266 that flows into the collector box manifold 282 and out of the furnace 200 through an exit vent (not shown). The induced draft blower 250 (FIG. 2A) may operate to assist in the removal of the exhaust from the tubes 262. As the fuel stream combusts in the tubes 262, the tubes 262 absorb heat from the combusted fuel and in turn heat the airstream 290 forced over the HX assembly 260 by the blower 120 of FIG. 1. The HX assembly 260 is configured to provide an AFUE of at least about 80%, meaning that at least about 80% of the heat produced by burning fuel entering the inlet 264 is transferred to the airstream 290.

The tubes 262 include a passageway between the inlet 264 and the outlet 266 such that the gas and air entering the tubes 262 stay in the tubes 262 until flowing out of the tubes 262 into the collector box manifold 282. The tubes 262 further include a first section 268 that includes the inlet 264, a horizontal section 270 with a first internal diameter, and a vertical section 272. The first section 268 comprises a 90-degree bend between the horizontal section 270 and the vertical section 272. The first section 268 is also designed to be a combustion region in which the fuel stream burns.

The tubes 262 also include a second section 274 extending from the first section 268 and comprising a second internal diameter less than the first internal dimeter. The second section further includes a serpentine flow path up and down in the vertical direction as well as the outlet 266. The exhaust gases from the first section 268 flow into the second section 274, which may be referred to as the exhaust region. The decrease in diameter from the first section 268 increases the velocity of the exhaust gases to assist in removing the exhaust gases from the tubes 262. The change in diameter may be any change in diameter suitable to effectively increase the velocity of the exhaust from the tubes 262. Optionally and as shown, the first sections 268 and the second sections 274 are separate parts joined together at a joint or connection 276. As an example, the connection 276 may comprise a pencil joint but may also comprise other suitable connections.

The second section 274 includes a serpentine flow path, e.g. wherein the passageway includes at least two changes of direction, such as turns 278. The turns 278 do not necessarily need to be continuous curve u-bends. Instead, the serpentine flow path may include turns 278 transitioning between up and down directions, wherein at least one of the turns 278 includes a straight section 279. The straight section 279 may be of a length that is minimized to prevent laminar flow from developing within the straight section 279.

As shown more clearly in FIG. 2C, the serpentine flow path portion of the second section 274 also comprises a wave, or zig-zag, pattern back and forth in the horizontal, or z-direction. The wave pattern may be such that the centerline of the tube 262 in the second section 274 crosses the centerline of the tube 262 in the first section 268 for at least one portion of the wave pattern. The wave pattern increases the surface area of the tubes 262 for the return pass back to the collector box manifold 282, thus increasing the efficiency of the HX assembly 260. Further, as also shown in FIG. 2C, the tubes 262 may be placed close enough together such that the wave or zig-zag patterns of the second sections 274 are nested, thus saving space and allowing for more tubes 262 within a given size cabinet 210.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. For example, certain embodiments disclosed here envisage usage with a powered fan rather than an inducer fan, or no fan at all. Moreover, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

What is claimed is:

1. A furnace heat exchanger assembly for combustion of gas fuel heat exchange comprising tubes, wherein each tube comprises:

a first section comprising an inlet, a horizontal section comprising a first internal diameter, and a vertical section, wherein the horizontal section and the vertical section define an x-y plane; and a second section extending from the first section and comprising:

a second internal diameter less than the first internal diameter;

a serpentine flow path comprising first straight sections extending in a y-direction and at least one turn section connecting at least two of the first straight sections of the serpentine flow path, wherein the at least one turn section comprises a second straight section extending at least partially in a z-direction perpendicular to the x-y plane such that the serpentine flow path extends back and forth at least partially in the z-direction; and an outlet;

wherein gas fuel entering a tube stays in the tube until flowing out of the tube.

2. The furnace heat exchanger assembly of claim 1, wherein the serpentine flow path also comprises a wave or zig-zag pattern back and forth at least partially in the z-direction.

3. The furnace heat exchanger assembly of claim 2, wherein the tubes are close enough together such that the wave or zig-zag patterns of the second sections are nested.

4. The furnace heat exchanger assembly of claim 1, wherein the first section extends from a support plate and the second section terminates in a collector box on a same side as the support plate.

5. The furnace heat exchanger assembly of claim 1, wherein the first and the second section of each tube comprise separate parts joined together.

6. The furnace heat exchanger assembly of claim 1, wherein the first section comprises a tapered end positioned within an open end of the second section.

7. The furnace heat exchanger assembly of claim 1, wherein the first section comprises a 90-degree bend between the horizontal section and the vertical section.

8. The furnace heat exchanger assembly of claim 1, wherein the furnace heat exchanger assembly comprises an annual fuel efficiency rating (AFUE) of 80% and a height low enough to fit in a 30-inch-tall furnace cabinet.

9. A furnace assembly for use with a gas fuel, comprising:

a cabinet;

a burner located in the cabinet, wherein the burner is operable to ignite the gas fuel;

a heat exchanger assembly in communication with the burner and open to receiving ignited gas fuel, the heat exchanger assembly comprising tubes, wherein each tube comprises:

a first section comprising an inlet, a horizontal section comprising a first internal diameter, and a vertical section, wherein the horizontal section and the vertical section define an x-y plane; and a second section extending from the first section and comprising:

a second internal diameter less than the first internal diameter;

a serpentine flow path comprising first straight sections extending in a y-direction and at least one turn section connecting at least two of the first straight sections of the serpentine flow path, wherein the at least one turn section comprises a second straight section extending at least partially in a z-direction perpendicular to the x-y plane such that the serpentine flow path extends back and forth at least partially in the z-direction; and an outlet;

wherein the gas fuel entering a tube stays in the tube until flowing out of the tube; and a blower operable to move air through the cabinet and over the heat exchanger assembly.

10. The furnace assembly of claim 9, wherein the serpentine flow path comprises a wave or zig-zag pattern back and forth at least partially in the z-direction.

11. The furnace assembly of claim 10, wherein the tubes of the heat exchanger assembly are close enough together such that the wave or zig-zag patterns of the second sections are nested.

12. The furnace assembly of claim 9, wherein the first section of the tubes of the heat exchanger assembly extends from a support plate and the second section terminates in a collector box on a same side as the support plate.

13. The furnace assembly of claim 9, wherein the first and the second sections of each tube comprise separate parts joined together.

14. The furnace assembly of claim 9, wherein the first section comprises a tapered end positioned within an open end of the second section.

15. The furnace assembly of claim 9, wherein the first section of the tubes comprises a 90-degree bend between the horizontal section and the vertical section.

16. The furnace assembly of claim 9, wherein the heat exchanger assembly comprises an annual fuel efficiency rating (AFUE) of 80% and a height low enough to fit in a 30-inch-tall furnace cabinet.

* * * * *